United States Patent [19]

Scott et al.

[11] 4,194,680

[45] Mar. 25, 1980

[54] OPENABLE CONTAINER COVER

[75] Inventors: Raymond G. Scott, Oak Brook; Lawrence S. Wysocki, Chicago, both of Ill.

[73] Assignee: Champion International Corporation, Stamford, Conn.

[21] Appl. No.: 972,039

[22] Filed: Dec. 21, 1978

[51] Int. Cl.[2] ..... B65D 5/54; B65D 5/64

[52] U.S. Cl. ..... 229/43; 206/609; 206/611; 206/612; 206/628; 206/633; 229/3.5 MF

[58] Field of Search ..... 229/3.5 MF, 43; 206/609, 611, 612, 628, 633

[56] References Cited

U.S. PATENT DOCUMENTS

| | | | |
|---|---|---|---|
| 1,827,636 | 10/1931 | Ames | 206/611 |
| 2,327,024 | 8/1943 | Davidson, Jr. et al. | 206/633 |
| 3,144,194 | 8/1964 | Cartwright | 206/628 |
| 3,244,356 | 4/1966 | Wolowicz et al. | 229/43 |
| 3,687,352 | 8/1972 | Kalajian | 206/612 |

*Primary Examiner*—Stephen P. Garbe

*Attorney, Agent, or Firm*—Evelyn M. Sommer

[57] ABSTRACT

A paperboard cover adapted for being marginally secured to a container for prepackaged foods comprises an angular cut and circular and semi-circular cut scores defining a lift tongue. A pull-tab in the form of a pressure-sensitive adhesive label or of a precut paperboard tab covers the angular cut and has a portion thereof facing the tip of the lift tongue firmly secured thereto by the adhesive while the part thereof overlapping the angular cut is easy to lift.

2 Claims, 4 Drawing Figures

OPENABLE CONTAINER COVER

BACKGROUND OF THE INVENTION

This invention relates generally to a protective cover for containers and in particular, it relates to a cover adapted to be used in connection with an aluminum pan containing raw corn kernels and oil covered by a thin aluminum foil folded or wrinkled in such a manner as to expand during heating of the container and its contents in order to accomodate the expanded volume of the popped corn. The aluminum foil used in such an expandable cover is of extremely thin gauge considerably thinner than the aluminum used for the bottom and sides of the pan. Owing to its thinness the aluminum foil in the cover is susceptible to damage or perforation. It is therefore necessary to employ an additional protective cover over the top of the expansible aluminum foil when it is offered for sale and the cover must be easily removable. Generally, a paperboard cover is used and, in addition to serving the protective function, it also permits display of advertising matter and identification of the product as well as directions for use. The paperboard cover is marginally anchored on the container by the crimping margin of the aluminum foil of both the expansible top and the relatively thick container sides.

Prior to heating the popped corn package, a major central part of the paperboard cover must be removed in order to permit the expansible aluminum top to expand through a remaining annular portion of the paperboard cover during the heating. This annular portion of the paperboard cover acts as a gasket for the pan and the thin expansible foil to reduce the loss of steam during popping thus causing the package to function successfully.

To facilitate the removal of the cover, one or more cut scores extend on both surfaces of the cover around the peripheral portion thereof. The depth of the cut scores is usually less than the depth of the paperboard cover. In order to define a finger tab there has been provided an angular cut terminating in the outer peripheral cut score. When the finger tab is gripped and pulled, the paperboard cover is thrown away along the cut score lines thereby exposing the expansible aluminum foil top and leaving, around the rim of the container a narrow marginal band of paperboard.

A paperboard container cover that is scored and cut so as to facilitate easy removal of a major portion thereof, as described hereinabove, is disclosed in U.S. Pat. Nos. 3,054,680 and 3,110,233.

Openable paperboard covers disclosed in the above patents have been used for several years in connection with the pop corn producing containers. The angular cut shape defining a finger tab which acts as a starter for the lid opening and removal of the same has been used because it helps minimize moisture vapor transmission and helps prevent accidental puncturing of the spun aluminum located underneath. Prior to using the angular cut shape, other die cut shapes were used, however, these proved faulty for one reason or another.

Nonetheless due to the fact that the angular pull tab is normally in the plane of the upper surface of the lip, it has been necessary first to lift the sides of the angular cut. The delicate spun aluminum foil has been frequently punctured by a fingernail or other object when the lid opening process has been started. A small protective circular top has been placed underneath the area of the angular cut but despite this precaution the above-mentioned problem has still taken place.

It is therefore a primary object of this invention to provide a paperboard cover for prepackaged foods container which eliminates the danger of puncturing the underlying aluminum foil of the container.

Another object of this invention is to improve existing cover with minimum structural changes.

SUMMARY OF THE INVENTION

In keeping with these and other objects which will become apparent hereinafter, one feature of this invention resides in applying a pressure sensitive adhesive label or tape over the existing angular cut. The adhesive action of the label is differentiated in such a manner that the part of the label covering the angular cut is firmly glued thereto whereas another part adheres to the upper surface of the cover only slightly so as to form an easy lift-up tab. In a modification a paperboard circular tab is folded over the angular cut and glued directly thereto by applying adhesive on the angular cut or an adjacent place. Preferably the attached circular tab is provided with two spaced series of perforations defining a tear strip following the contour of a pair of cut scores on the upper surface of the cover. The cover itself is made of a substantially flat paperboard sheet having four cut scores. A first and a third cut score are on the upper surface of the sheet and extend around it in spaced relationship to each other and to the edge. A second and a fourth cut score are on the lower or opposed surface of the sheet, out of register with but spaced substantially uniformly from the respective first and third cut scores. The combined depth of the cut scores on the lower surface with those on the upper surface are about the same as the thickness of the sheet. The angular cut defining the finger pull tab extends substantially radially between and terminates in the first and third cut scores.

The novel features which are considered as characteristic for the invention are set forth in the appended claims. The invention itself, however, together with additional objects and advantages thereof, will be best understood from the following description of specific embodiments when read in connection with the accompanying drawing.

DESCRIPTION OF THE PREFERRED EMBODIMENTS

Figure 1:
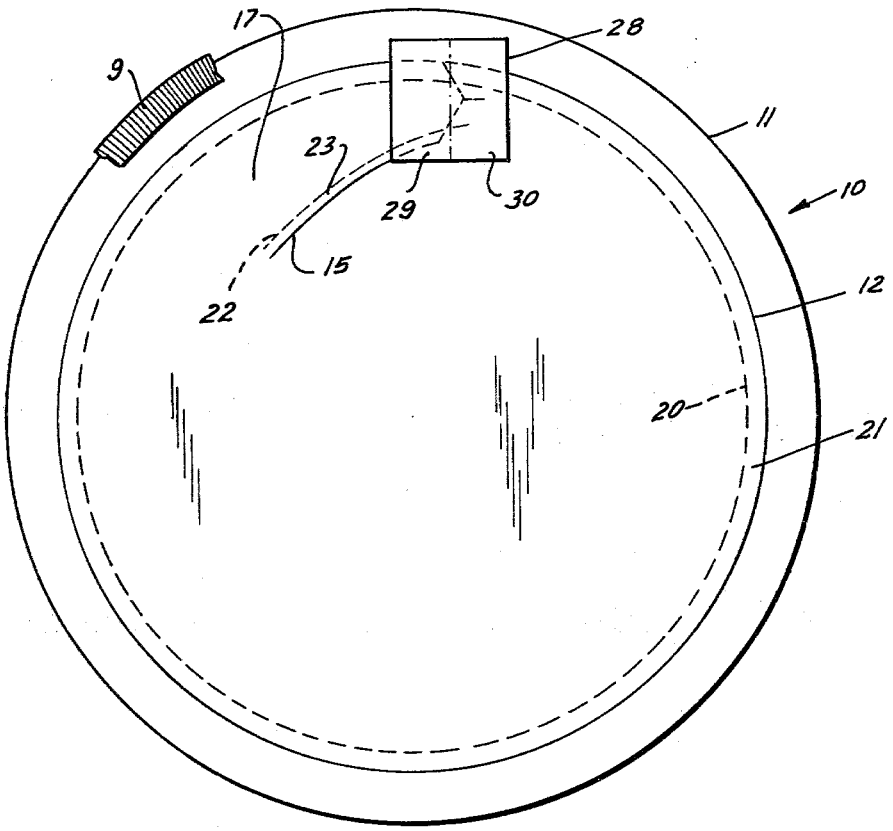
FIG. 1 shows a top view of one embodiment of this invention employing a pressure sensitive adhesive label or tape.
Figure 4:
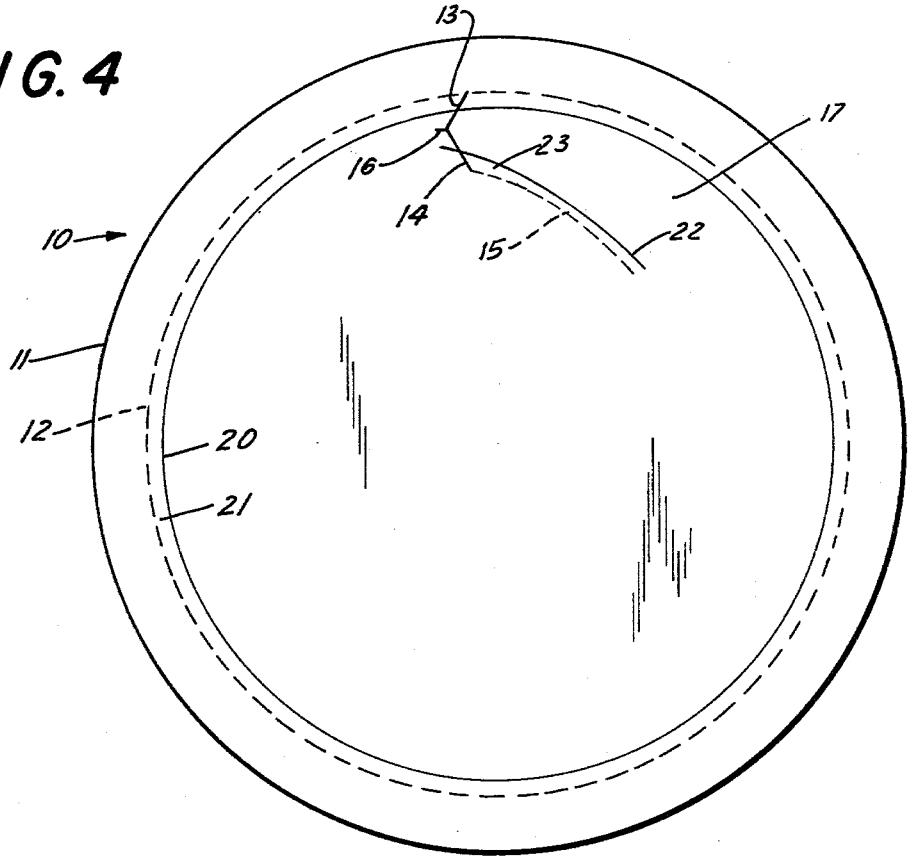
FIG. 4 is a fragmentary bottom view of the openable cover according to FIGS. 1 and 3.

FIG. 4 shows the bottom of an existing container cover 10 designed to be crimped along its peripheral edge 11 by the sides of an aluminum pan and an expansible aluminum top foil 9 (e.g., as shown in FIG. 1). The upper surface of cover 10 is provided with a continuous outer cut score line 12 which is spaced from the outer edge 11 of the cover. A second cut score line 15 is formed on the upper surface of the cover in spaced relation to cut score line 12. As shown in FIG. 1, cut score line 15 diverges from the cut score line 12 and extends across only a relatively small portion of cover 10 defining a tongue like area 17. An angular tab defined by cross cuts 13 and 14 bridges the narrow part of the tongue 17 whereby the outer cut 13 terminates in the outer continuous cut score 12 and the inner cut 14 terminates in the inner cut score 15. Cuts 14 and 13 extend through the thickness of the cover 10. There may be provided an additional small cut 16 terminating at the apex of the angular cut. Before use, the angular cut of the tab is in the plane of the paperboard cover.

The bottom surface of cover 10 is provided with a continuous cut score line 20 conforming in shape to and being uniformly spaced inwardly from cut score line 12. A second cut score line 22 on the lower surface is uniformly spaced outwardly from cut score line 15. Cut score line 22 begins in the region of the angular cut 13, 14 and 16 and is uniformly spaced from the cut score 15. In this manner the cut scores 12 and 20 define a ring 21 and cut scores 15 and 22 define a tearstrip 23. Between the tear strip 23 and the opposite section of the ring 21 results the aforementioned starting tongue 17 converging to and terminating in the angular cut 13 and 14 at one end and diverging to the rest of the major portion of the cover 10 to the opened and discarded.

Hitherto, when it has been desired to remove the portion of the cover 10 deliminated by the outer cut score line 12, the user pressed down at point 16 and gripped the tip of the angular tab formed by cuts 13 and 14 and pulled the same in the direction of the tongue 17 tearing along cut score lines 15 and 22 and 12 and 20, thereby removing the major portion of cover 10, leaving only portion 11 crimped to the container.

As mentioned in the description of the background of this invention, the depression at the point 16 may cause fracture of the underlying expansible aluminum foil covering the prepackaged foods. According to this invention, this danger has been eliminated by applying a patterned positive pressure sensitive adhesive label or tape 28 over the upper surface of the cover 10 in the region of the tab formed by the cuts 13 and 14. The adhesive label or tape 28 has its adhesive layer patterned so that the part thereof 29 covering the angular cut and the tip of the tongue 17 is applied to the surface of cover 10 with maximum adhesive force whereas the area 30 overlapping the angular cut 13 and 14 is applied on the surface with minimum pressure so that the adhesive force is weak and the portion 30 of the label serves as an easy lift tab to start the opening operation.

Figure 2:
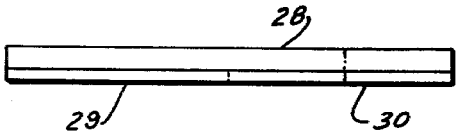
FIG. 2 is an enlarged side view of the patterned adhesive label of FIG. 1.

FIG. 2 shows in greater detail the corresponding part 29 of the adhesive layer with maximum adhesion and the easy lift up part 30 with the minimum adhesion.

Figure 3:
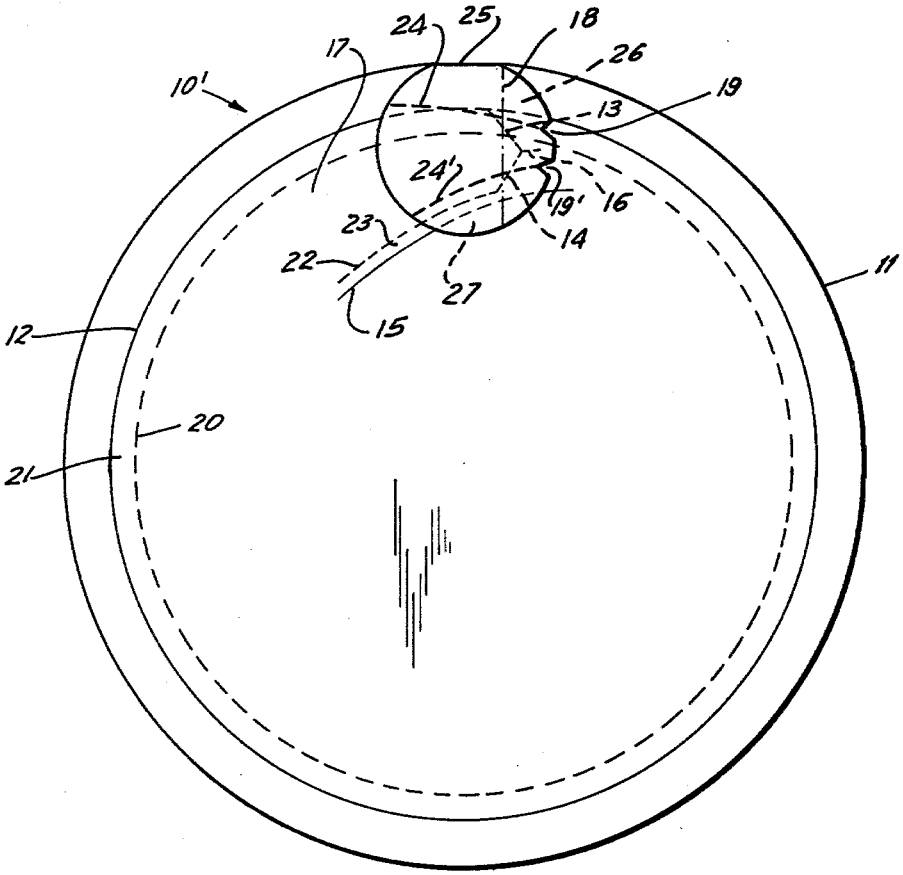
FIG. 3 is a top view of another embodiment of the openable cover of this invention employing a perforated tab.

Referring now to FIG. 3, there is shown another preferred embodiment of the openable cover 10' according to this invention. The basic structure and layout of the cut score lines and cross cuts is the same as in the preceding embodiment with the exception that the cover 10' is die cut together with a small circular satellite tab 18 connected to the edge 11 of the cover 10' at the edge area 25 near to the angular cut 13 and 14. The tab 18 is provided with two series of perforations 24 and 24' defining therebetween a tear strip corresponding substantially to a portion of the tear tongue 17 in the cover. The tab 18 is folded along perforations adjacent the connection line 25 over the upper surface of the cover 10 so that the perforations 24 and 24' are approximately in register with the facing cut score 15 and 12. In connecting the tab 18 adhesive is applied preferably in three places, adjacent the edge area 25, either on the lower area 27 of the tab 18 or onto the opposite area on the upper surface of the cover 10' proper and between the perforations 24 and 24' behind cross cut 13 and 14. The portion 26 of the tab 18 overlapping or exceeding the cross cut 13, 14 and 16 is left unglued so that if forms an easy lift tab portion suitable for being gripped by fingers and pulled when starting the cover opening process. Preferably, V-shaped cuts 19 are provided in this unglued portion 26 and the perforations 24 and 24' terminate in the apexes of these cuts 19 so that the tearing action is easily facilitated.

Removal of the inner portion of the cover 10' would be much the same as in the preceding example. When using the term "applied adhesive agent," this indicates either wet adhesive, hot melt, flame sealing or heat and pressure sealing.

To facilitate the handling of the circular cover 10 or 10' in gluing operation, it is preferred to cut the paperboard sheet with at least one straight side tangential to the edge 11. This straight side would enable the circle when fed into the glue machine to travel parallel to the frame of the gluing machine.

It will be understood that each of the elements described above, or two or more together, may also find a useful application in other types of protective covers differing from the type described above.

What is claimed as new and desired to be protected by Letters Patent is set forth in the appended claims.

1. An openable cover adapted to span and be marginally secured to a container comprising in combination: a substantially flat paperboard sheet having a first cut score on the upper surface thereof; a second cut score on the lower surface thereof; said cut scores extending therearound and being substantially uniformly spaced from each other and from the edge of the sheet, a third cut score spaced inwardly from the first cut score on the upper surface of the sheet, a fourth cut score spaced inwardly from the second cut score on the lower surface of said sheet, the combined depths of said first and second cut scores and of said third and fourth cut scores being approximately the thickness of the sheet; an angular cut extending between and terminating in said first and third cut scores to define a pull tongue normally lying in the plane of the sheet; and a pull tab normally disposed on the upper surface over the area of said angular cut, a part of said pull tab being affixed to said pull tongue and the other part of the pull tab overlapping said angular cut to define an easy lift portion of the tab, said pull tab being a paperboard piece lying on the upper surface of the cover over and around the area of said angular cut, a part of said paperboard piece being glued to the lift tongue and a part thereof overlapping the angular cut, being without adhesives to serve as an easy lift portion, said paperboard piece having a circular shape and being provided with two series of perforations extending substantially along said first and third scores, to define a tear strip therebetween.

2. A cover as defined in claim 1, wherein the easy lift portion of the pull tab is provided with a pair of V-shaped cutouts, said series of perforations terminating respectively in the apexes of said cutouts.

* * * * *